US008042320B2

(12) United States Patent
Miller et al.

(10) Patent No.: US 8,042,320 B2
(45) Date of Patent: Oct. 25, 2011

(54) WORKSTATION OF A PACKAGING MACHINE HAVING A LIFTING DEVICE

(75) Inventors: Dietmar Miller, Ungerhausen (DE); Konrad Moessnang, Mindelaltheim (DE)

(73) Assignee: Mutlivac Sepp Haggenmüller GmbH & Co. KG (DE)

( * ) Notice: Subject to any disclaimer, the term of this patent is extended or adjusted under 35 U.S.C. 154(b) by 290 days.

(21) Appl. No.: 12/384,666

(22) Filed: Apr. 6, 2009

(65) Prior Publication Data

US 2009/0260320 A1 Oct. 22, 2009

(30) Foreign Application Priority Data

Apr. 18, 2008 (DE) ..... 10 2008 019 626

(51) Int. Cl.
*B65B 47/00* (2006.01)
*B65B 65/00* (2006.01)
*F16H 21/16* (2006.01)

(52) U.S. Cl. ..... 53/559; 53/393; 74/45; 74/48; 74/50; 100/280

(58) Field of Classification Search ..... 53/427, 53/453, 509, 559, 561, 393; 100/280; 74/45, 74/47–50; *B65B 65/00, 65/02, 65/04, 9/04, B65B 47/04, 47/08, 47/10, 51/14*
See application file for complete search history.

(56) References Cited

U.S. PATENT DOCUMENTS

| | | | | | |
|---|---|---|---|---|---|
| 624,755 | A | * | 5/1899 | Cress | 74/48 |
| 2,236,460 | A | * | 3/1941 | Thomas | 100/280 |
| 2,622,445 | A | * | 12/1952 | Benedict | 74/50 |
| 2,712,717 | A | * | 7/1955 | Keller | 53/559 |
| 3,397,508 | A | * | 8/1968 | Stroop | 53/559 |
| 3,410,201 | A | | 11/1968 | Swede | |
| 3,714,758 | A | * | 2/1973 | Vogeleer | 53/329.3 |
| 3,808,772 | A | | 5/1974 | Turtschan | |
| 3,946,537 | A | * | 3/1976 | Hair et al. | 53/559 |
| 4,094,127 | A | * | 6/1978 | Romagnoli | 53/559 |
| 4,115,979 | A | * | 9/1978 | Morini | 53/393 |
| 4,262,470 | A | * | 4/1981 | Reuter et al. | 53/202 |
| 4,329,830 | A | * | 5/1982 | Omori | 53/561 |
| 4,490,963 | A | * | 1/1985 | Knudsen | 53/559 |
| 4,622,793 | A | * | 11/1986 | Oki | 53/374.8 |
| 4,794,224 | A | * | 12/1988 | Spektor et al. | 219/216 |

(Continued)

FOREIGN PATENT DOCUMENTS

DE 1 511 488 1/1970

(Continued)

OTHER PUBLICATIONS

European Search Report, Application No. 09158038.1-2308, Applicant Multivac Sepp Haggenmuller GmbH & Co KG, Dated Aug. 18, 2009—5 Pages.

(Continued)

*Primary Examiner* — Stephen F Gerrity

(74) *Attorney, Agent, or Firm* — Brooks Kushman P.C.

(57) ABSTRACT

A workstation of a packaging machine comprises a lifting device (100) which is configured such that it is able to convert a rotary motion of a motor (8) into a translator motion of the workstation by a lever device (6). The stroke of the lifting device (100) is performable for this purpose by a pivotable lever (61) and a roller (32) which cooperates with an upper roller limit (33).

21 Claims, 8 Drawing Sheets

U.S. PATENT DOCUMENTS

| | | | | | |
|---|---|---|---|---|---|
| 4,840,010 | A | * | 6/1989 | Focke et al. | 53/376.6 |
| 4,848,173 | A | * | 7/1989 | Heinrichs | 74/84 R |
| 4,885,900 | A | * | 12/1989 | Lohr et al. | 53/551 |
| 5,031,470 | A | * | 7/1991 | Karlsson | 74/50 |
| 5,125,497 | A | * | 6/1992 | Sundermann | 198/463.3 |
| 5,170,611 | A | | 12/1992 | Buchko et al. | |
| 5,307,692 | A | * | 5/1994 | Kaplan | 53/453 |
| 5,517,805 | A | | 5/1996 | Epstein | |
| 6,035,733 | A | * | 3/2000 | Yoshizawa | 74/45 |
| 6,085,497 | A | | 7/2000 | Natterer | |
| 7,398,633 | B1 | * | 7/2008 | Chiang | 53/509 |
| 2002/0023417 | A1 | | 2/2002 | Becker | |
| 2004/0050020 | A1 | | 3/2004 | Hanson et al. | |
| 2009/0241486 | A1 | * | 10/2009 | Buchko et al. | 53/393 |

FOREIGN PATENT DOCUMENTS

| | | | | |
|---|---|---|---|---|
| DE | 691 01 374 | T2 | | 6/1994 |
| DE | 199 60 084 | A1 | | 6/2001 |
| DE | 102 53 993 | A1 | | 6/2004 |
| DE | 103 27 092 | A1 | | 12/2004 |
| DE | 103 10 029 | | | 7/2007 |
| EP | 0 895 934 | A1 | | 2/1999 |
| JP | 06056118 | A | * | 3/1994 |
| WO | WO-92/10405 | | | 6/1992 |

OTHER PUBLICATIONS

Bibliographic data: DE10310029 (A1), Raising and lowering mechanism for a machine part of plastic thermoforming and/r container sealing equipment comprises a lever mounted by a joint on a guide block moving transverse to set guide line:, http://worldwide,espacenet.com/publicationDetails/biblio?DB+EPODOC&adjacent=true&...,Mar. 16, 2009, 1 Page.

* cited by examiner

WORKSTATION OF A PACKAGING MACHINE HAVING A LIFTING DEVICE

The present invention refers to a workstation of a packaging machine having a lifting device, in particular for a chamber belt machine or a workstation for moulding, sealing and/or cutting in deep drawing machines or tray closing machines.

In the field of chamber belt machines normally the vacuum chamber is formed by a lid and a lower portion. The lid is moved by a pneumatic work cylinder. Since pressurized air is relatively expensive as drive medium this construction has as a consequence high cost for operating the lifting of the lid.

Therefore, it is the object of the present invention to provide a workstation of a packaging machine with an improved lifting device. Preferably, the operation of the workstation should be of low cost.

By the inventive configuration of the lifting device of the workstation of the packaging machine it is not necessary anymore to provide pressurized air. The lifting motion of the corresponding workstation is realized by the employment of an electric motor for which it is only necessary to provide electrical energy.

Figure 1:
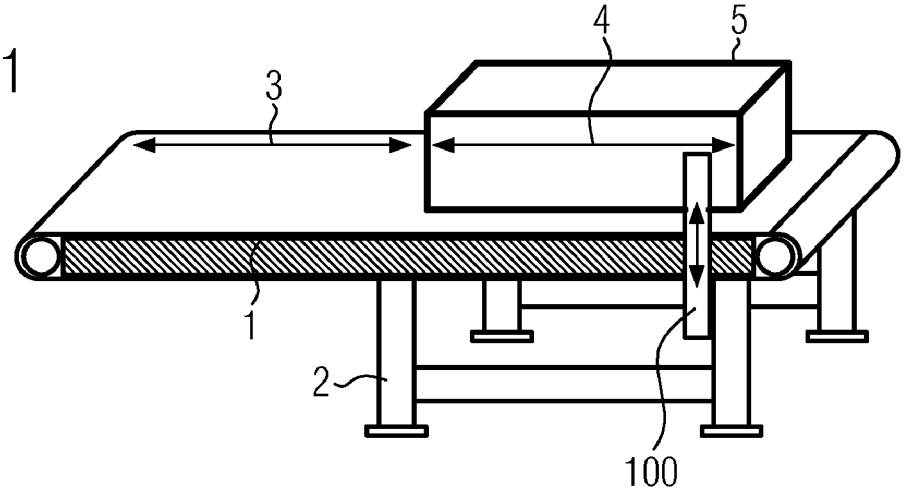
Figure 2A:
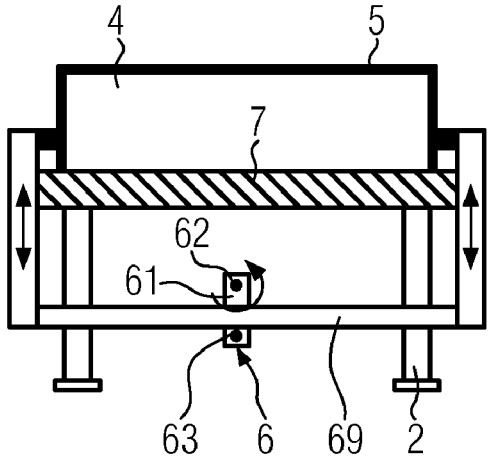
Figure 2B:
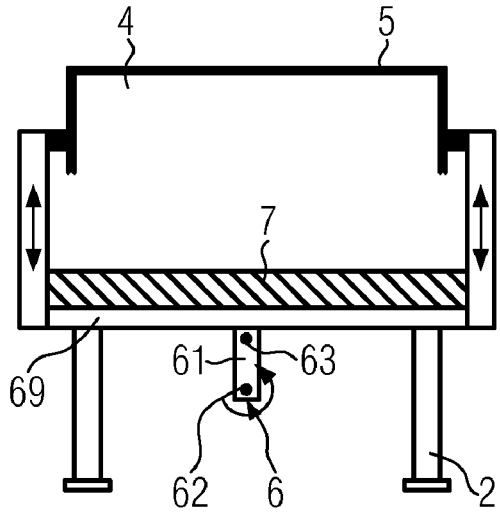
Figure 3A:
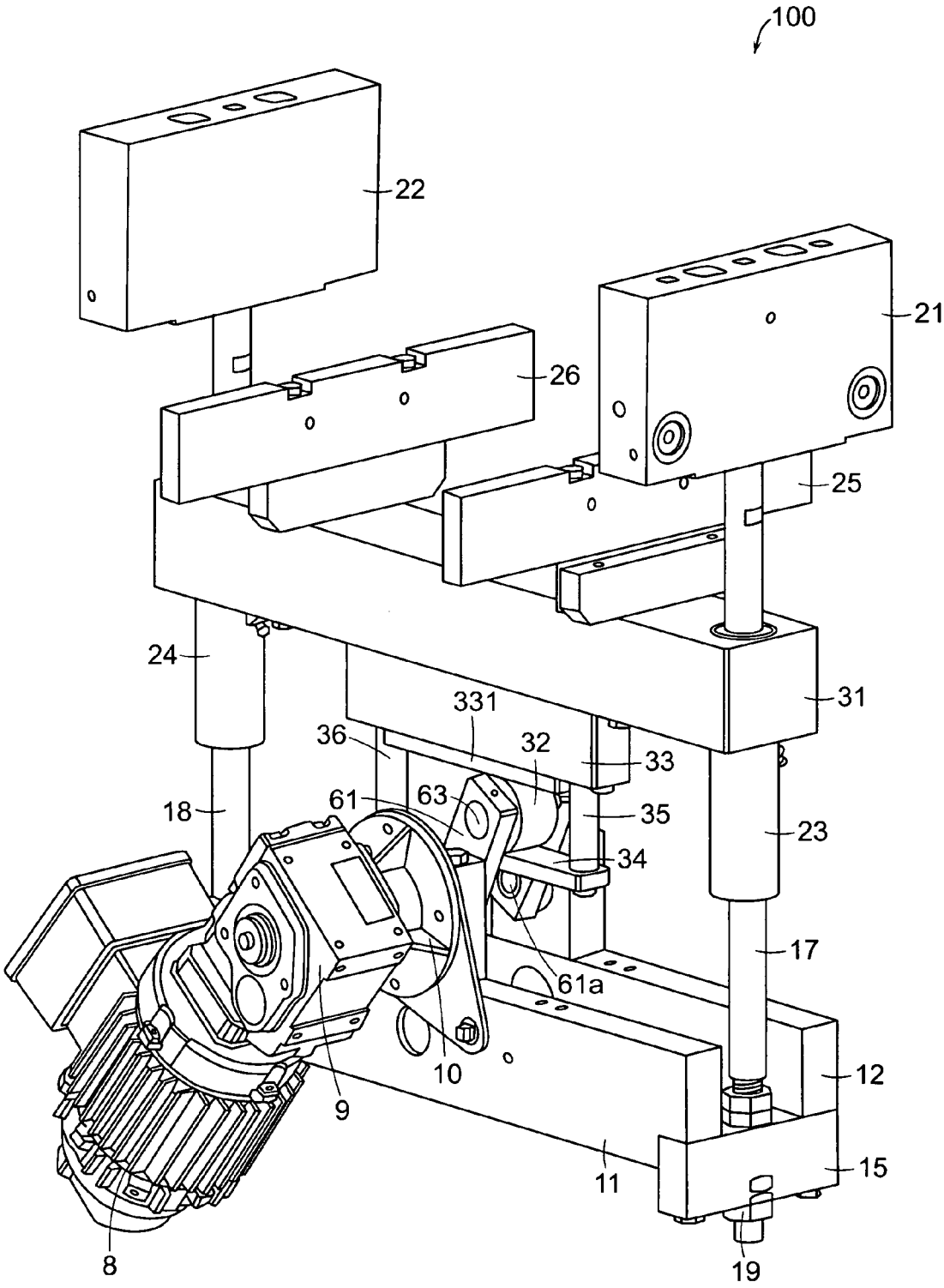
Figure 3B:
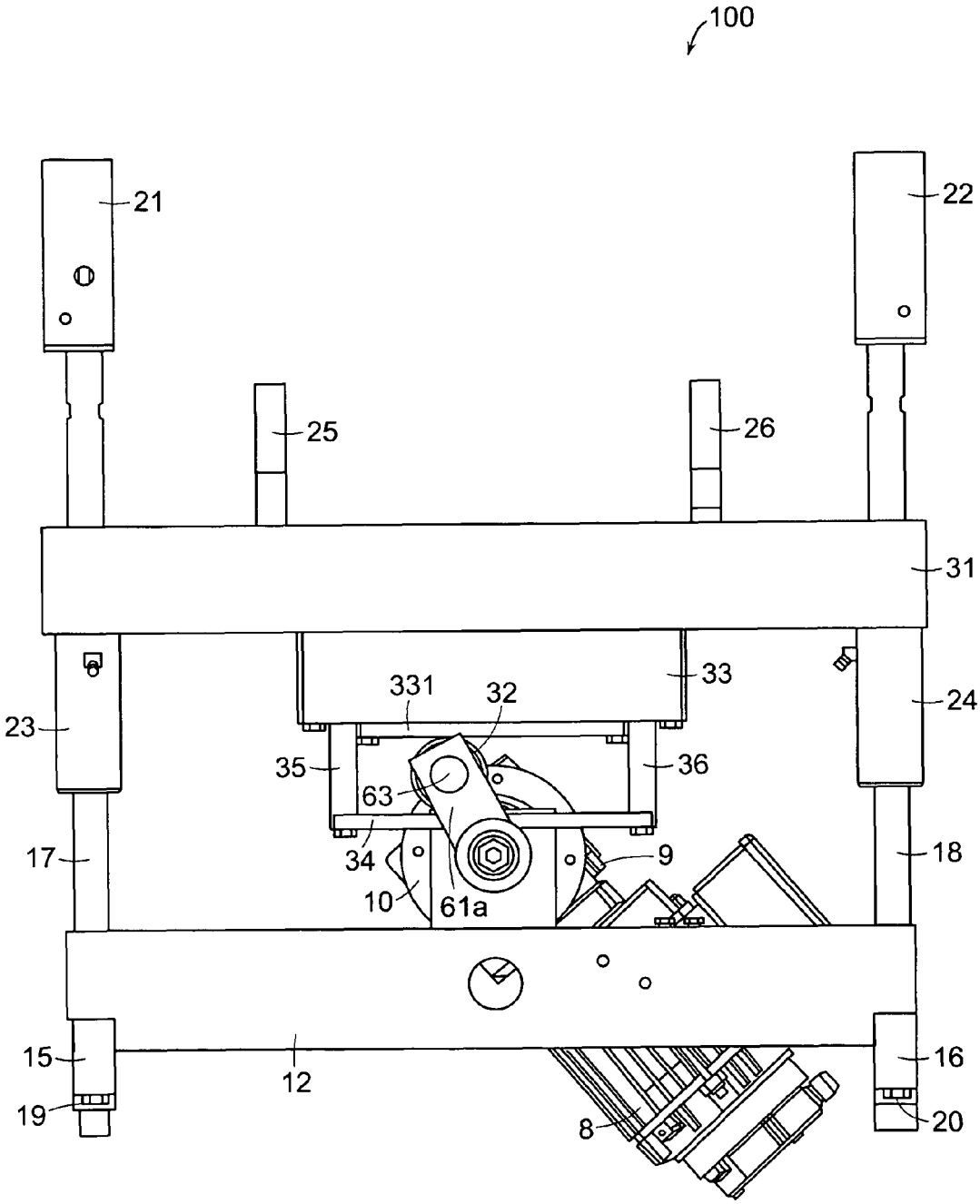
Figure 4A:
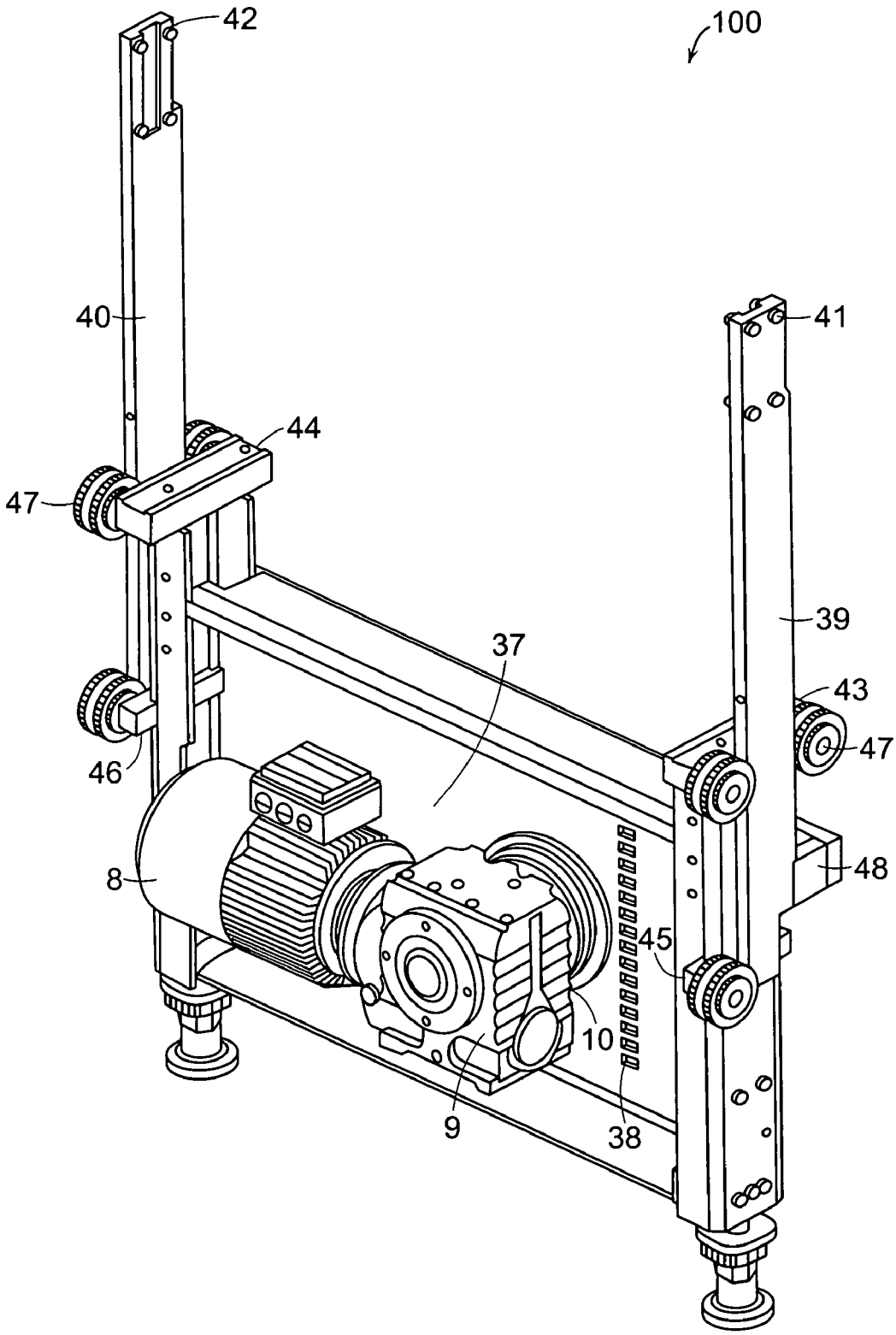
Figure 4B:
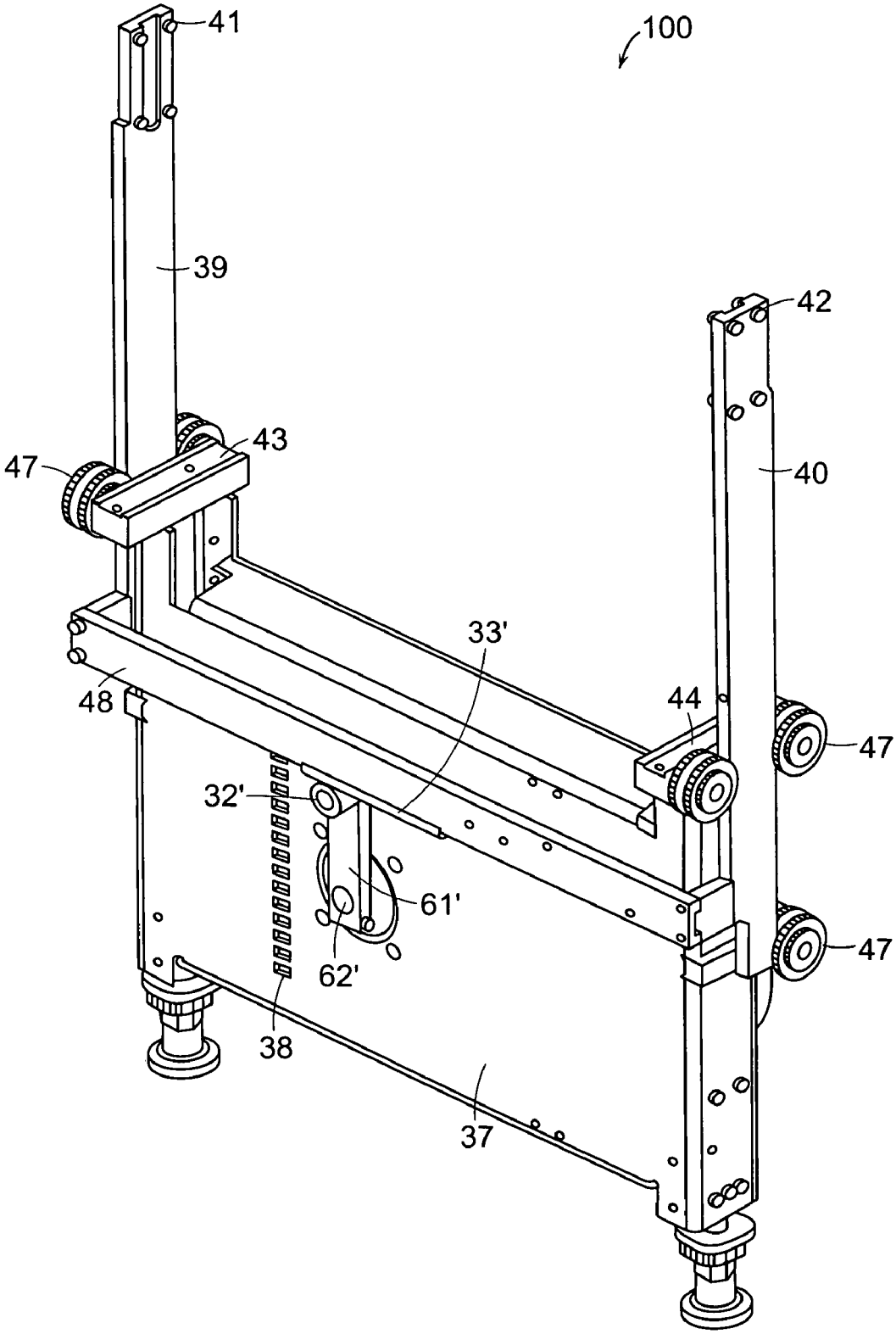
Figure 5A:
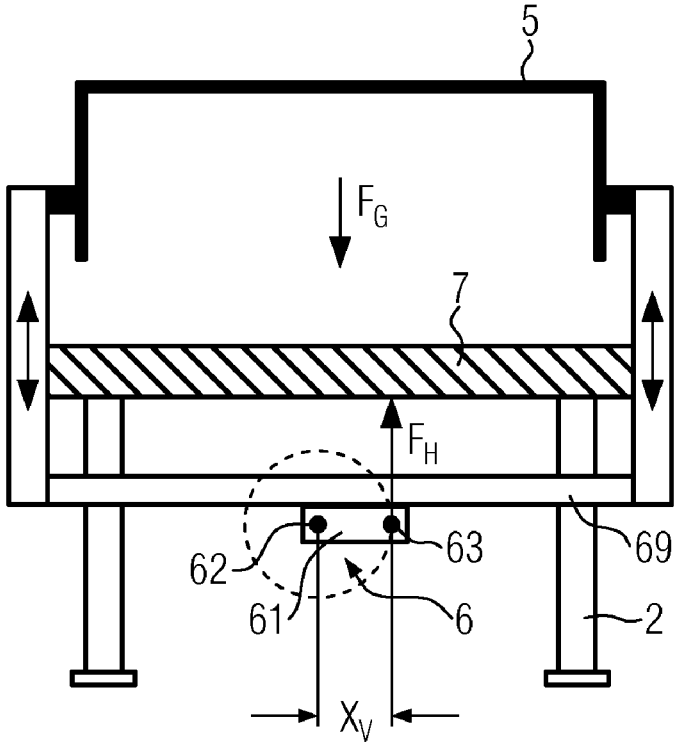
Figure 5B:
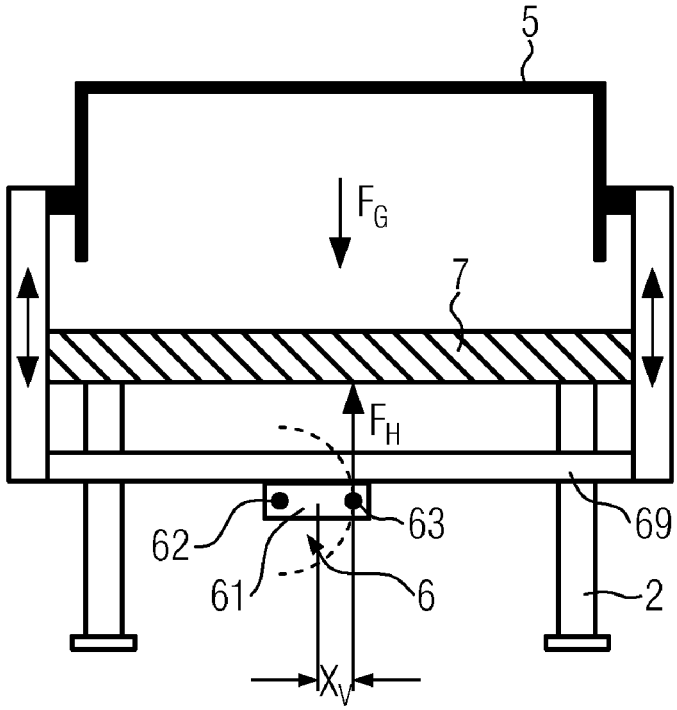
Figure 6A:
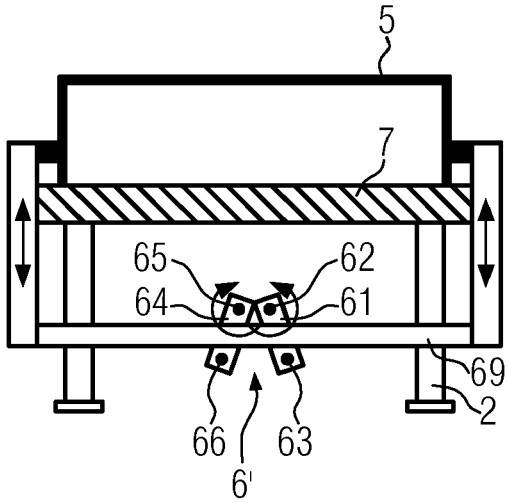
Figure 6B:
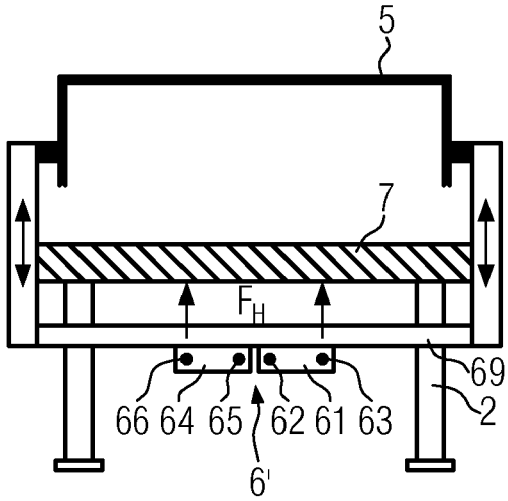
Figure 6C:
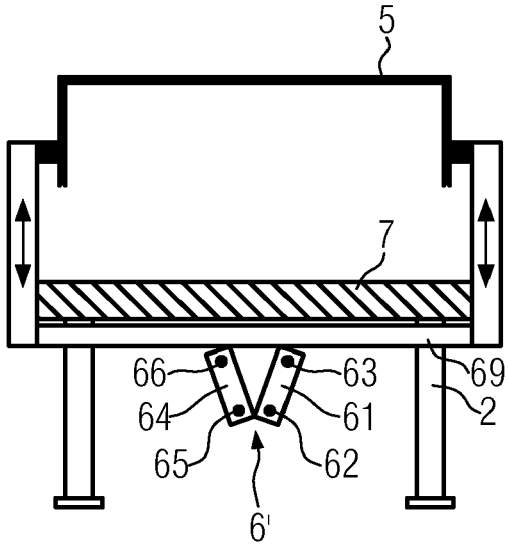
Figure 7:
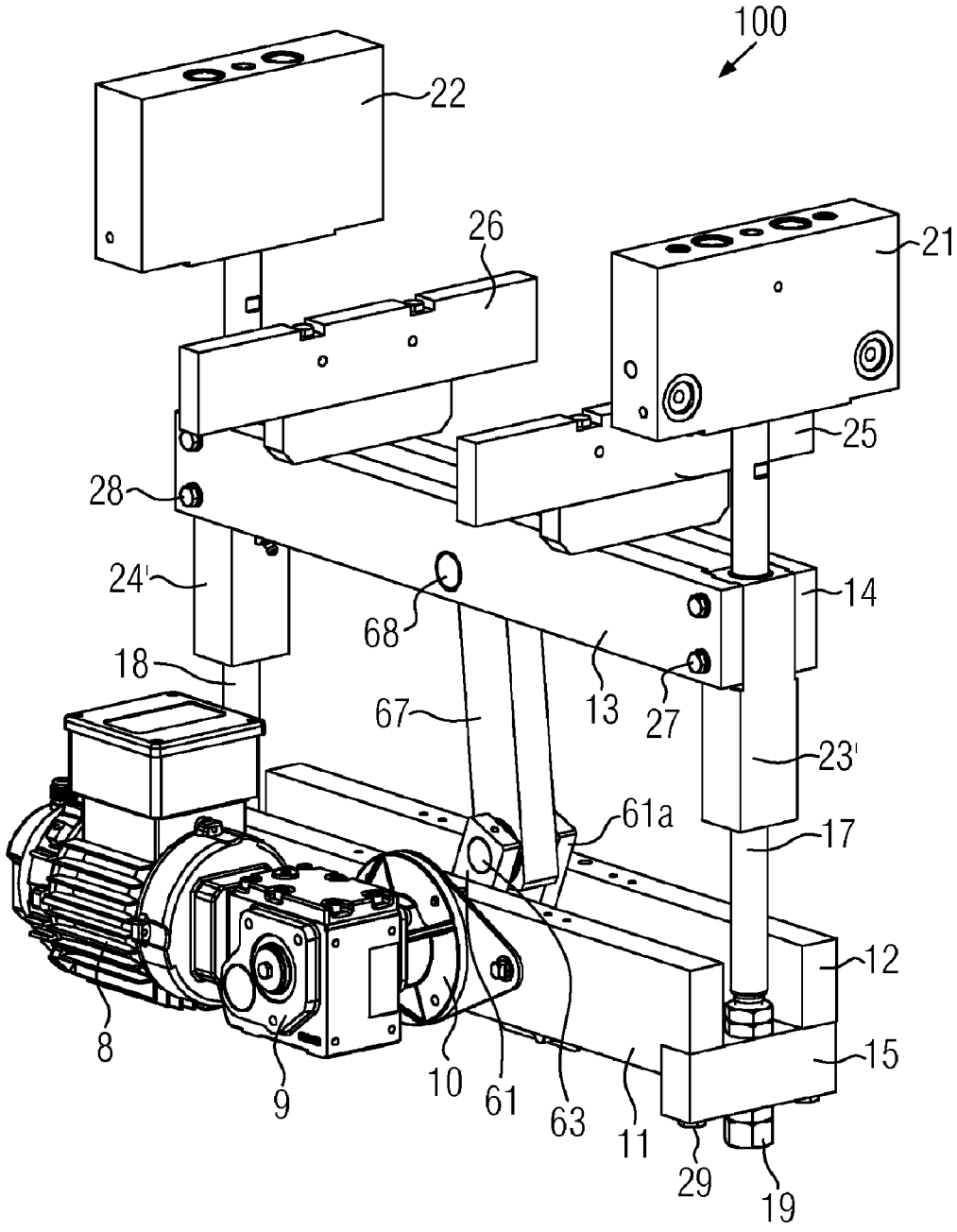

Further features and advantages of the invention follow from the description of embodiments referring to the enclosed drawings. From the figures show:

FIG. 1 a schematical side view of a chamber belt machine;

FIG. 2*a* a schematical front view of the chamber belt machine having a centred lever device with lifted lid;

FIG. 2*b* a schematical front view of the chamber belt machine having a centred lever device with raised lid;

FIG. 3*a* a schematical perspective front view of the lifting device according to a first embodiment;

FIG. 3*b* a schematical perspective back view of the lifting device according to a first embodiment;

FIG. 4*a* a schematical perspective front view of the lifting device according to a second embodiment;

FIG. 4*b* a schematical perspective back view of the lifting device according to a second embodiment;

FIG. 5*a* a schematical front view of the chamber belt machine with centred lever device and a lever arm $X_V$ drawn in;

FIG. 5*b* a schematical front view of the chamber belt machine having an eccentric lever device and a lever arm $X_V$ drawn in;

FIG. 6*a* a schematical front view of the chamber belt machine having a double lever device with the lid in a lowered position;

FIG. 6*b* a schematical front view of the chamber belt machine having a double lever device with the lid in the centred position;

FIG. 6*c* a schematical front view of the chamber belt machine having a double lever device with the lid in the raised position;

FIG. 7 a schematical perspective front view of the lifting device in a further embodiment.

A first embodiment of the invention is described in the following referring to FIG. 1 to FIG. 3*b* exemplarily with a chamber belt machine. In the present embodiment the chamber belt machine is realized as an automatic chamber belt machine.

FIG. 1 shows a schematical view of a chamber belt machine having a conveyor belt 1, a rack 2, a placing region 3, a chamber 4 with a lid 5, and a lifting device 100. The chamber 4 is formed by the lid 5 together with the conveyor belt 1, the lid 5 automatically opening motor driven or is able to be opened manually, in order to accommodate for example bags (not shown) to evacuated or to be sealed which are supplied by the conveyor belt 1 automatically, and which closes thereafter.

FIG. 2*a* shows the lever device 6 having a first lever 61, first driving pin 62 and a pivot pin 63. The first driving pin 62 is stationary and pivotable for example by an electric motor. The first pivot pin 63 is pivotable about the first driving pin 62. In FIG. 2*a* the lid 5 is connected with a component part (indicated by a double arrow) with a cross strut 69, which again bears on the first pivot pin 63 in this position of the lid 5. The pivot pin 63 extends out of the drawing plane, the first driving pin 62 extends into the drawing plane and the first lever 61 is situated behind the cross strut 69 with respect to the drawing plane. The lid 5 is in a lowered position in this arrangement. The chamber 4 is closed.

FIG. 2*b* shows the same structure as FIG. 2*a*, the lid 5 being in the raised position. The chamber 4 is open.

During the operation the first pivot pin 63 can lift the lid 5 by a rotation of the first lever 61 about the first driving pin 62 by a rotation by 180° by means of the cross strut 69. The cross strut 69 or the lid 5, respectively, a pressed upwardly by the projecting first pivot pin 63, wherein the first pivot pin 63 slides along the cross strut 69. The direction of rotation of the first lever 61 is designated by an arrow anticlockwise. However, a rotation in the opposite direction is also possible.

FIG. 3*a* shows a schematical perspective view of a possible embodiment of the present invention, in particular for workstations, in a deep drawing machine or a tray closing machine, as moulding stations, sealing stations and/or cutting stations. A first support 11 and a second support 12 formed in the same manner are provided which are connected to each other by a shorter first cross support 15 and a second cross support 16 formed in the same manner (see FIG. 3*b*). These four supports together form the basis for the lifting device 100.

Each of the first cross support 15 and the second cross support 16 (see FIG. 3*b*) comprise a vertical central bore which accommodates a first rod 17 and a second rod 18, respectively. The first rod 17 and the second rod 18 are connected with first fixing elements 19 and second fixing elements 20, respectively, (see FIG. 3*b*) with the cross supports 15, 16. The first rod 17 and the second rod 18 extend in the vertical direction upwardly and finish each in a first hanging device 21 and a second hanging device 22, respectively. These hanging devices 21, 22 are connectable with the machine rack of the packaging machine.

A motor 8 as an electric motor or a following gear case 9 are connected through a gear case flange 10 with the first support 11. The motor 8 drives through the gear case 9 the first driving pin 62 (see FIG. 2*a, b*), being rotationally stationary connected with the first lever 61. The first lever 61 encloses together with a lever opposite part 61*a* being rotationally stationary connected with the first lever 61 through the pivot pin 63, a roller 32. The rotation axis of the roller 32 is in the same axis as the axis of the first pivot pin 63 which forms the shaft of the roller 32 being supported for example by a roller bearing. The roller 32 is moveable in a circular movement about the axis of the first driving pin 62. The roller 32 is limited by an upper roller limit 33 and lower roller limit 34. The upper roller limit 33 and the lower roller limit 34 are connected by a first connecting bolt 35 and a second connecting bolt 36. The lever opposite part 61*a* prevents together with the first lever 61 during operation a sliding of the roller 32 in the direction of its rotation axis. Furthermore, the first lever 61 can rotate about the first driving pin 62 about 360° by this construction. Through the two roller limits 33, 34 as well as the closed flow of forces of the construction a raising force and a lowing force can be transmitted to the corresponding workstation.

Furthermore, the upper roller limit 33 comprises a roller guide 331 which has direct contact with the roller 32. This roller guide 331 is formed planar in this embodiment. It is also conceivable that the roller guide 331 is formed at an end at least in a curved shape. In this manner during the operation of the inventive device further raising of the workstation of the packaging machine to be raised in the end stage of the lifting motion can be realized. By a slight tapering of the roller guide 331 a large force can be transmitted during small lifting motion, in order to press a sealing tool for example.

The whole arrangement of the upper roller limit 33, the lower roller limit 34, the first connecting bolt 35, and the second connecting bolt 36 is connected to the upper roller limit 33 by a fifth support 31, which again is arranged vertically slideable. For this part the fifth support 31 is formed in the shape of a beam and comprises vertical through bores at both ends thereof. The fifth support 31 all together with the upper roller limit 33 and the lower roller limit 34, respectively, are guided or vertical slideable by the first rod 17 and the second rod 18, respectively. In addition to guiding by the fifth support 31 at both rods each a first sliding bearing 23 and a second sliding bearing 24 are provided which essentially comprise the shape of a hollow cylinder which is closed at the upper end thereof by the lower side of the fifth support 31. A first lower portion connecting element 25 and a second lower portion connecting element 26 which serve for connecting the lifting device 100 with the corresponding workstation of the packaging machine, are connected to the fifth support 31.

FIG. 3*b* shows a rear view of the device described in FIG. 3*a*. The rotation motion generated by the motor 8 is converted by the first lever 61 and the roller 32, respectively, into a translatory motion during the operation. The group of elements consisting of the upper roller limit 33 and the roller guide 331, respectively, the lower roller limit 34, the first connecting bolt 35, the second connecting bolt 36, the fifth support 31, the first lower portion connecting element 25 and the second lower portion connecting element 26 and the two sliding bearings 23, 24, respectively, is raised and lowered, respectively, by the first rod 17 and the second rod 18 in order to raise or lower, respectively, the corresponding workstation as for example the lid 5 or a molding, sealing, or cutting station.

FIG. 4*a* shows a second embodiment of the present invention, in particular for workstations in deep drawing machines or tray closing machines, for example moulding stations, sealing stations and/or cutting stations. A base plate 37 is provided with a plurality of vertically arranged measuring holes 38 which together with a sensor serve as a measuring device. The motor 8 is connected with the base plate 37 through a gear case 9 or a gear case flange 10. Furthermore, a first linear guiding roll accommodation 43 and a second linear guiding roll accommodation 44 and a third linear guiding roll accommodation 45 and a fourth linear guiding roll accommodation 46, respectively, are connected with the base plate 37, the first and the second linear guiding roll accommodation 43, 44 each carrying two linear guiding rolls 47, and the third linear guiding roll accommodation 45 and the fourth linear guiding roll accommodation 46 each carrying a linear guiding roll 47. Between the two linear guiding rolls 47 of the first and the second linear guiding roll accommodations 43, 44 each a first linear guiding 39 and a second linear guiding 40, i.e. on both sides of the base plate 37 are vertically slideable arranged. At each of the upper ends of the first linear guiding 39 and the second linear guiding 40 a first linear guiding fastening element 41 and a second linear guiding fastening element 42, respectively, are provided which serve for connection of the corresponding workstation of the packaging machine, which is to perform a lifting motion.

FIG. 4*b* shows the arrangement described in FIG. 4*a* of the second embodiment of the present invention in a perspective rear view. The gear case output sharp (not shown) of the gear case 9 drives the first drive pin 62'. For this purpose a circular bore is provided in the base plate 37 through which the first drive pin 62' penetrates. At the first drive pin 62' the first lever 61' is moveably fixed and accommodated at its other end the roller 32'. This roller 32' cooperates with the upper roller limit 33' in the operation. The upper roller limit 33' is connected with a linear guide connecting element 48 which is connected with the first linear guide 39 and the second linear guide 40, respectively. The whole group of elements consisting of the first linear guide 39, the second linear guide 40 and the upper roller limit 33' is slideable in the vertical direction. They are guided by the linear guide rolls 47. Since only the upper roller limit 33' is realized a force can be transmitted only during raising the corresponding workstation. The lowering motion of the workstation takes place by the weight force of the workstation. Therefore, the lower roller limit 34 (see FIGS. 3*a, b*) can be omitted.

It is conceivable to provide additional linear guides for a better stabilisation of the lifting device 100.

FIG. 5*a* shows in a schematical front view the lever device 6 which is centrally arranged in this embodiment, i.e. that the stationary first drive pin 62 is centrally arranged under the lid 5. The point of action of the first pivot pin 63 is central only in the lowest and the uppermost position. The shown position of the lifting device the first lever 61 and the first pivot pin 63, respectively, are provided in a position intermediate. In this position the point of action of the force is maximally shifted. A tilting moment acts onto the lifting device by the lever $X_V$.

FIG. 5*b* shows the same structure as 5*a* with the exception that the lever device is arranged eccentrically. In this manner the point of action of the force of the first lever 61 can be shifted in this intermediate position, and therefore the active lever arm $X_V$ and the resulting tilting moment acting onto the lifting device 100 can be reduced. The point of rotation of the first drive pin 62 can essentially shifted by the half length of the first lever 61 outside the centre which has as a consequence that the resulting moment is halved. Preferably, the first lever 61 carries out a rotation by 180° dependant on shifting of the first drive pin 62 to the left or to the right.

FIG. 6*a* shows in a further embodiment of the present invention a double lever device 6' with the first lever 61, the first drive pin 62, the first pivot pin 63, a second lever 64, a second drive pin 65 and a second pivot pin 66. In this manner tilting moments which act onto the lifting device 100 are eliminated during the operation they cancel each other during the same shift of the first drive pin 62 and the second drive pin 65. The operation of this embodiment (see FIGS. 6*a, b, c*) is analogue to the operation described with regard to FIG. 2*a, b*. The lid 5 is in the lowered position.

FIG. 6*b* shows the lid 5 in an intermediate position.

FIG. 6*c* shows the lid 5 in a raised position.

FIG. 7 shows a similar structure as FIG. 3*a* with the exception that the first pivot pin 63 is connected with a connecting-rod 67 which is supported between a third support 13 and a fourth support 14. The third support 13 and the fourth support 14 and the first sliding bearing 23' and the second sliding bearing 24', respectively, fulfil the same function as the fifth support 31 and the first sliding bearing 23 and the second sliding bearing 24, respectively (see FIG. 3*a*). The motor 8 and the gear case 9 and the gear case flange 10 are arranged horizontally to the bottom in this embodiment. In this embodiment in all intermediate positions in which the connecting-rod 27 is not exactly vertically adjusted, cross forces act onto the lifting device 100.

The invention is not restricted to the application in a chamber belt machine. It is also applicable to a chamber belt machine without conveyor belt.

Furthermore, the invention is not restricted in that the chamber is formed by a lid and a part of the conveyor belt. Rather the chamber can be formed by a lid and a lower portion.

Furthermore, the invention is not restricted to the employment of the lifting device for a lid. Rather the lifting device is applicable for a plurality of workstations, as e.g. moulding, sealing and/or cutting stations in a packaging machine as e.g. a deep drawing machine or a tray closing machine.

The invention claimed is:

1. A workstation of a packaging machine, the workstation comprising:

a lid that at least partially defines a chamber, the lid being movable between a lowered position in which the chamber is closed, and a raised position in which the chamber is open; and a lifting device for moving the lid, the lifting device comprising a motor configured to generate rotary motion, and a lever device associated with the motor, the lever device including a pivotable lever, a roller connected to the lever, and an upper roller limit that is associated with the lid and cooperable with the roller to perform a stroke of the lifting device, the lever being pivotable about a pivot axis that is arranged eccentrically with respect to a centerline of the lid, the centerline lying in a plane that passes through the upper roller limit;

wherein rotary motion of the motor is converted into translatory motion of the lid by means of the lever device.

2. The workstation according to claim 1, wherein the upper roller limit is formed with a curved shape or with a taper.

3. The workstation according to claim 1, wherein the motor and the lever device are configured such that the lever is pivotable at least about 360°.

4. The workstation according to claim 1, wherein the lever device is structured and arranged eccentrically with respect to the lid to reduce a tilting moment that acts on the lifting device through the lever device during lifting of the lid.

5. The workstation according to claim 1, further comprising a lower roller limit positioned beneath the upper roller limit and being cooperable with the roller to transmit a lowering force to the lid.

6. The workstation according to claim 5, wherein the roller is located between the upper roller limit and the lower roller limit.

7. The workstation according to claim 1, wherein the lever device further comprises a lever opposite part spaced away from the lever and connected to the lever, and wherein the roller is enclosed between and confined by the lever and the lever opposite part.

8. The workstation according to claim 1, wherein the workstation comprises a moulding station and/or a sealing station and/or a cutting station.

9. The workstation according to claim 1, wherein the packaging machine is a deep drawing machine and/or a tray closing machine.

10. The workstation according to claim 1 wherein the motor and the lever device are positioned beneath the lid.

11. The workstation of claim 1 wherein the lever has a length, and the pivot axis is offset with respect to the centerline of the lid by generally half the length of the lever.

12. A workstation of a packaging machine, the workstation comprising:

a lid that at least partially defines a chamber, the lid being movable between a lowered position in which the chamber is closed, and a raised position in which the chamber is open; and a lifting device for moving the lid, the lifting device comprising a motor configured to generate rotary motion, and a lever device associated with the motor and the lid, the lever device including a pivotable lever and a connecting rod pivotally connected to the lever to perform a stroke of the lifting device;

wherein rotary motion of the motor is converted into translatory motion of the lid by means of the lever device.

13. The workstation according to claim 12, wherein the workstation comprises a moulding station and/or a sealing station and/or a cutting station.

14. The workstation according to claim 12, wherein the packaging machine is a deep drawing machine and/or a tray closing machine.

15. The workstation according to claim 12 wherein the motor and the lever device are positioned beneath the lid.

16. A workstation of a packaging machine, the workstation comprising:

a movable component; and a lifting device comprising a movable cross member associated with the component, first and second lever devices that cooperate with the cross member to move the component, and a motor associated with the first lever device and configured to generate rotary motion, the first lever device including a first lever that is rotatable in a first direction about a first pivot axis and a roller connected to the first lever, the second lever device including a second lever that is rotatable in a second direction opposite the first direction about a second pivot axis positioned proximate the first pivot axis and being offset with respect to the first pivot axis, such that tilting moments that act on the lifting device through the levers during movement of the component by the lifting device cancel each other, and wherein each lever has a distal end spaced away from the respective pivot axis and positioned proximate the cross member, and the distal ends are spaced farther apart than the pivot axes when the levers are each in a horizontal position;

wherein rotary motion of the motor is converted into translatory motion of the component by the first lever device, and wherein the cross member defines an upper roller limit that cooperates with the roller of the first lever device to perform a stroke of the lifting device.

17. The workstation of claim 16 wherein the motor is connected to the first lever for rotating the first lever.

18. The workstation according to claim 16 wherein the first lever device further comprises a lever opposite part connected to the first lever, and wherein the roller is enclosed between and confined by the first lever and the lever opposite part.

19. The workstation according to claim 16 wherein the component comprises a lid that at least partially defines a chamber, the lid being movable between a lowered position in which the chamber is closed, and a raised position in which the chamber is open.

20. A workstation of a packaging machine, the workstation comprising:

a movable component; and a lifting device for moving the movable component, the lifting device comprising a motor configured to generate rotary motion, and a lever device associated with the motor, the lever device including a pivotable lever, a roller connected to the lever, and an upper roller limit that is associated with the component and cooperable with the roller to perform a stroke of the lifting device, the lever being pivotable about a pivot axis that is eccentrically located with respect to a vertical plane that passes through a center of the component, and the lever being movable to a position in which the lever extends on both sides of the plane;

wherein rotary motion of the motor is converted into translatory motion of the component by the lever device.

21. The workstation of claim 20 wherein the lever has a length, and the pivot axis is offset with respect to the plane by generally half the length of the lever.

* * * * *